US007942019B2

(12) United States Patent
Ericsson

(10) Patent No.: US 7,942,019 B2
(45) Date of Patent: May 17, 2011

(54) EJECTOR PUMP IN DEVICE FOR COOLING/HEATING SYSTEMS

(76) Inventor: Svenning Ericsson, Torslanda (SE)

( * ) Notice: Subject to any disclaimer, the term of this patent is extended or adjusted under 35 U.S.C. 154(b) by 453 days.

(21) Appl. No.: 12/091,204

(22) PCT Filed: Nov. 3, 2006

(86) PCT No.: PCT/SE2006/001245

§ 371 (c)(1),
(2), (4) Date: Apr. 23, 2008

(87) PCT Pub. No.: WO2007/055635

PCT Pub. Date: May 18, 2007

(65) Prior Publication Data

US 2009/0272145 A1 Nov. 5, 2009

(30) Foreign Application Priority Data

Nov. 10, 2005 (SE) ..... 0502488-0

(51) Int. Cl.
*F25B 43/00* (2006.01)

(52) U.S. Cl. ..... 62/503; 62/509

(58) Field of Classification Search ..... 62/500, 62/503, 509; 417/151

See application file for complete search history.

(56) References Cited

U.S. PATENT DOCUMENTS

| | | | | |
|---|---|---|---|---|
| 2,859,596 | A | 11/1958 | Evans | |
| 4,187,695 | A | 2/1980 | Schumacher | |
| 4,474,034 | A | 10/1984 | Avery, Jr. | |
| 5,752,390 | A * | 5/1998 | Hyde | 62/196.4 |
| 6,145,332 | A | 11/2000 | Hyde | |

FOREIGN PATENT DOCUMENTS

| | | | |
|---|---|---|---|
| JP | 11148695 | A | 9/1999 |
| SU | 866287 | A | 10/1982 |

* cited by examiner

*Primary Examiner* — Melvin Jones
(74) *Attorney, Agent, or Firm* — David A. Guerra

(57) ABSTRACT

The present invention concerns a cooling or heating system including at least a compressor (10), a coolant tank/accumulator (4), a condenser (11), an inspection glass device with ejector pump (1, 2) for circulation and control of coolant, coolant and a vaporizer (13). The invention is characterized essentially in that the system comprises: a connection (8) to the ejector pump (1, 2), for intake of condensate from the condenser (11), an exit connection (9) from the ejector pump (1, 2), for connection to the vaporizer (13) and means (3) for visually controlling the ejector pump (1, 2). The invention also concerns a device (12) for controlling the coolant of a cooling or heating apparatus.

16 Claims, 3 Drawing Sheets

EJECTOR PUMP IN DEVICE FOR COOLING/HEATING SYSTEMS

CROSS-REFERENCE TO RELATED APPLICATIONS

This application is an U.S. national phase application under 35 U.S.C. §371 based upon co-pending International Application No. PCT/SE2006/001245 filed on Nov. 3, 2006. Additionally, this U.S. national phase application claims the benefit of priority of co-pending International Application No. PCT/SE2006/001245 filed on Nov. 3, 2006 and Sweden Application No. 0502488-0 filed on Nov. 10, 2005. The entire disclosures of the prior applications are incorporated herein by reference. The international application was published on May 18, 2007 under Publication No. WO 2007/055635 A1.

TECHNICAL FIELD

The present invention concerns a cooling or heating system including at least a compressor, a condenser, a tank/accumulator and a vaporiser. The invention also concerns a device for use in such a system.

STATE-OF-THE-ART

On the market there are many different systems for circulation of coolants in flooded evaporators for cooling systems, freezer systems, heat pump systems. The systems are used for cooling and heating purposes.

However, the circulation systems that are used are often complicated and have large volumes and are thereby needlessly expensive. The size and complexity of the systems also entails that their usefulness and effectiveness is lower than expected. Below some already known systems and apparatus that have some of the above mentioned disadvantages will be briefly described.

US2004/0255612 A1 and US2005/0204771 A1 concern different ejector systems that circulate coolant liquid on evaporation surfaces by sucking in liquid mixed gas from vaporisers and thereafter separating the liquid gas mixture in a tank/accumulator. Circulation depends on pressure maintenance across the vaporiser, among other things, the ejector pump's capacity is affected significantly also by the quality of the sucked in liquid gas mixture. The systems include inspection glasses for checking the amount of coolant in the system.

U.S. Pat. No. 5,247,813 A describes inspection glasses mounted in the suction channel from the accumulator/tank.

JP7043052 describes an inspection glass mounted on the coolant tank after the condenser for checking the amount of coolant in the cooling system and an inspection glass mounted on the channel after the coolant tank for detection of the coolant content in the cooling system.

The above mentioned documents are all provided with some drawbacks in that they do not see to that the amount and quality of the coolant can be controlled in a satisfying manner.

There is thus a need of a system that solves the problems of the above said systems in a simple flexible and easy way.

SUMMARY OF THE INVENTION

A purpose of the present invention is therefore to, among others; solve the above mentioned problem by simple and effective means.

The said purpose is achieved in a cooling or heating system comprising a connection to the ejector pump, for intake of condensate from the condenser, an exit connection from the ejector pump, for connection to the vaporiser, and means for visually controlling the ejector pump. Preferred embodiments are set forth in the associated dependent claims.

The invention also relates to a device for controlling the coolant of a cooling or heating system comprising an ejector pump, means arranged to enable visual control of the ejector pump, a connection arranged for intake of condensate from a condenser, and an exit connection arranged for connection to a vaporiser.

BRIEF DESCRIPTION OF THE FIGURES

In the following the invention will be described in a non-limiting way and by way of illustration with reference to the attached figures in which.

DETAILED DESCRIPTION OF THE INVENTION

Figure 1:
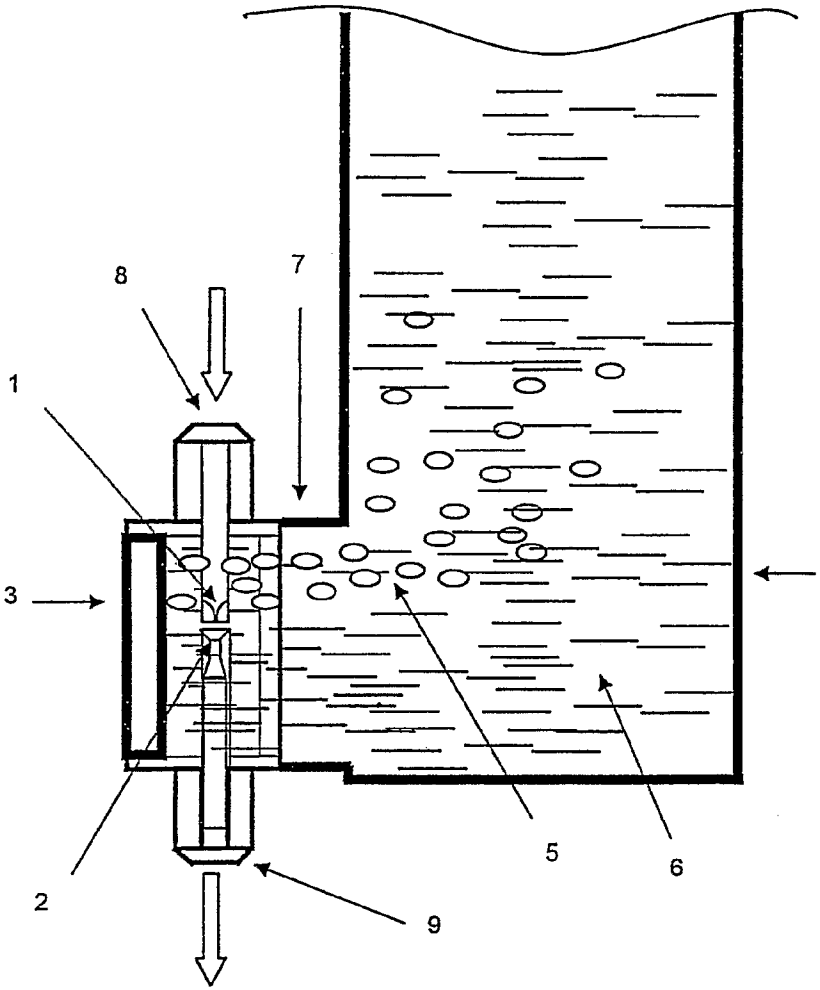
FIG. 1 shows an inspection glass device with ejector pump connected to the tank according to a preferred embodiment according to the present invention in section from the side and with fittings.
Figure 2:
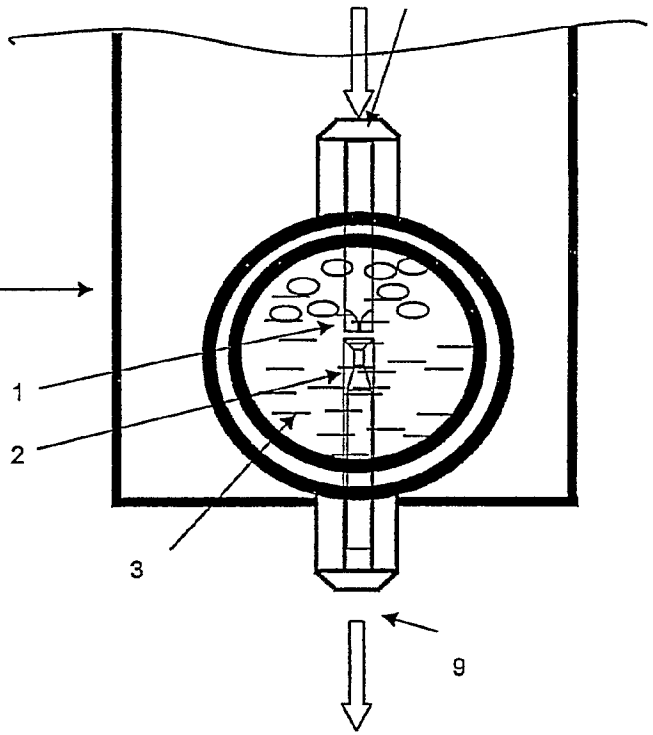
FIG. 2 shows an inspection glass device with ejector pump connected to the tank according to a preferred embodiment according to the present invention from the front with fittings.
Figure 4:
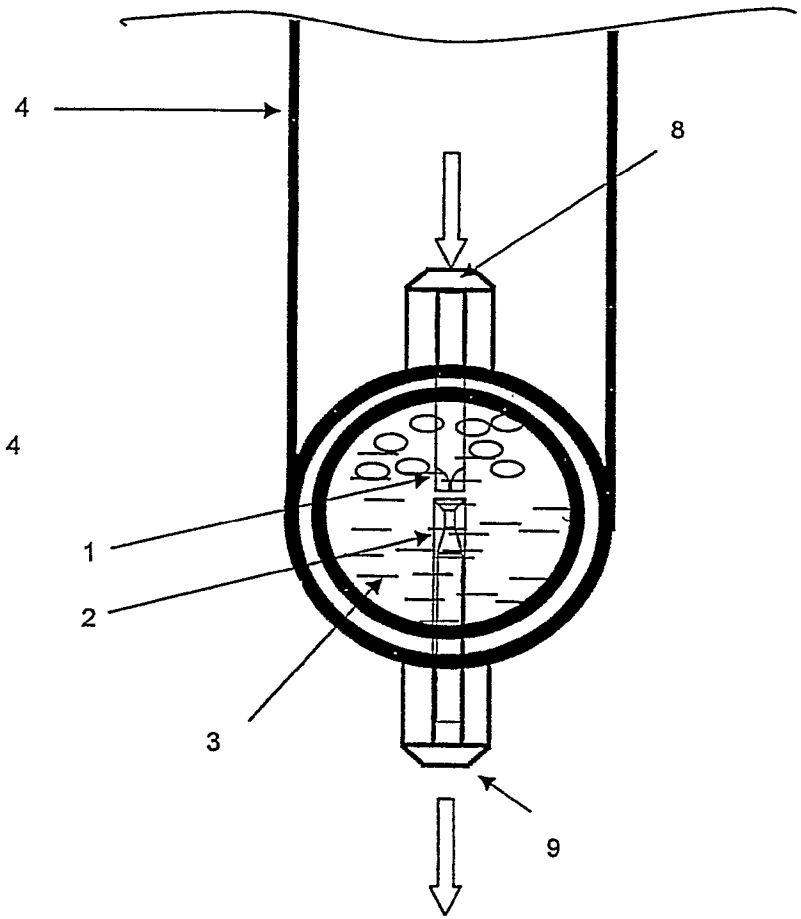
FIG. 4 shows an inspection glass device with ejector pump with an alternative connection to the tank according to FIG. 3 according to a preferred embodiment of the present invention from the front with fittings.
Figure 3:
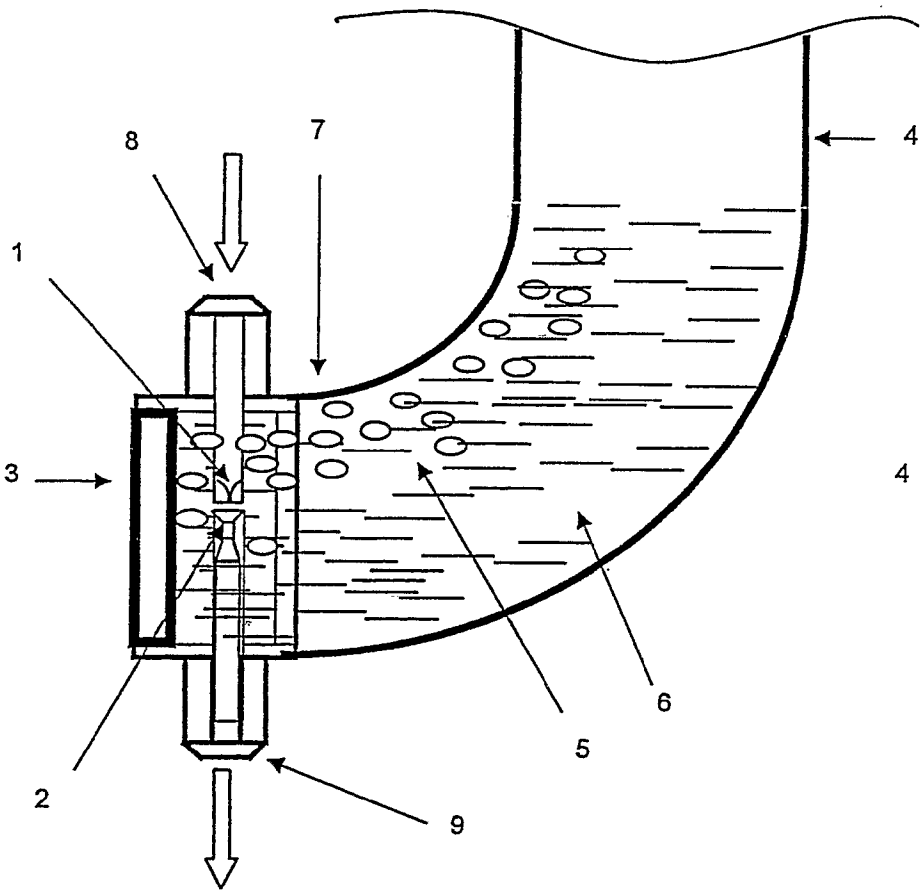
FIG. 3 shows an inspection glass device with ejector pump with an alternative connection to the tank according to a preferred embodiment according to the present invention in section from the side with fittings.

In FIGS. 1-5 an inspection glass device is shown equipped with a visible ejector pump 1, 2 with spray nozzle 1 and diffuser 2 for heating, cooling, or freezing systems. The ejector pump is used in flooded evaporator systems for cooling or heating purposes. With diffuser is meant a device that under increased pressure decelerates a flowing medium. With evaporating and condensing media for cooling or heating purposes, the ejector pump 1,2 acts as an expansion device.

Apart from the actual inspection glass 3 and ejector pump 1, 2 the inspection glass device 12 consists of: a connection 7 for the tank with coolant on the opposite side of the glass 3 for communication of coolant between the tank 4 and the ejector pump 1, 2, a connection for the coolant inlet 8 directly from the condenser alternatively after a choke apparatus/expansion apparatus 14, a connection 9 for coolant for connection to the vaporiser. The connection 7 between the tank 4 and the ejector pump 1, 2 is preferably shaped so that the coolant without difficulty can move between the tank and the area around the pump. The ejector nozzle 1 is shown in the drawings as a fixed orifice expansion device without the possibility of modulation, but it can also consist of a flow regulating spray nozzle for control of the amount of coolant. The control signal to the ejector nozzle can for instance be the control signal described in the Applicant's own application PCT/SE2006/000680 where in this case the expansion apparatus' spray nozzle is arranged in the inspection glass apparatus.

Figure 5:
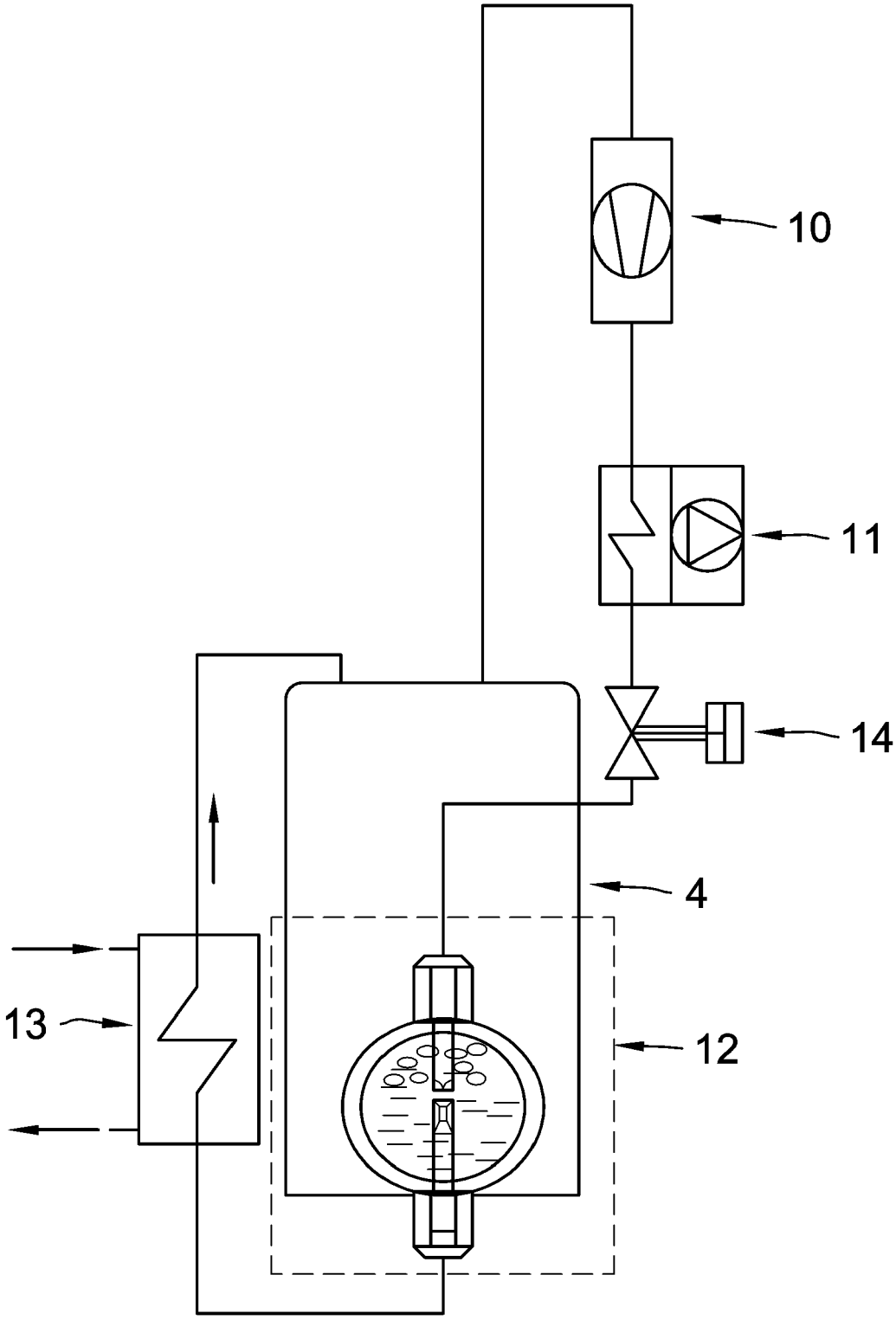
FIG. 5 shows a coolant system for cooling or heating purposes with an inspection glass device with ejector and bubble separation according to the present invention mounted on the tank.

FIG. 5 shows an example of a cooling/heating system with compressor 10, condenser 11, tank/accumulator 4, inspection glass device, ejector pump device and gas separation 12 according to a preferred description, vaporiser 13, coolant pipe and coolant with bubbles inside the inspection glass.

When the ejector nozzle 1 is pressurised and coolant condensate/liquid gas mixture from the condenser 11 flows through it, it leaves the nozzle mouth and expands thereafter with high speed jet. The coolant condensate/liquid gas mixture is formed by the nozzle to a jet that because of the nozzle's 1 design and placement is directed into the diffusor 2. Coolant 6 from the tank 4 is sucked into the jet and mixed with the coolant condensate jet from the nozzle 1, whereafter the mixture is pressed into the ejector diffusor 2 after which mixing of the two liquids/gas mixtures takes place. When the mixture has taken place there is also a pressure increase of the sucked in liquid from the tank 4. The mixture is led thereafter via the connection 9 into the pipe or channel to the vaporiser 13 whose function is to take up heat from the environment and vaporize coolant liquid. Between the condenser 11 and the ejector nozzle 1, whereafter the refrigerant expands, can as an alternative, an expansion apparatus 14 be arranged as a choke complement to the ejector pump nozzle.

The inspection glass 3 in the device 12 according to the invention provides good control of the coolant liquid to the ejector pump 1, 2. The amount of gas bubbles 5 formed around the ejector pump 1, 2 is led effectively away via the tank connection 7 to the tank 4. The bubbles are led away due to gravity. Therefore it is preferable if the ejector pump 1,2 is arranged in, or in connection with, the lower part of the tank 4. The amount of evaporated liquid formed in the space around the ejector pump 1, 2 is led into the coolant tank 4 whereby the ejector pump's 1, 2 intake receives a lesser quantity of gas bubbles and a larger quantity of liquid in the coolant whereby the mass flow increases.

Using the inspection glass provides a lot of advantages to the system in regards to controlling or inspecting the coolant, the ejector pump 1,2 and/or the gas bubbles. The gas bubbles may e.g. appear due to condensate heat. As mentioned above, the device is preferably arranged in, or in connection with, the lower part of the tank 4. This causes gas bubbles to be diverted from the ejector pump's intake and into the tank without disturbing the pump's intake of coolant from the tank. This would of course be achieved even by constructing the device without visual inspecting means 3. However, this would cause a lot of modifications to the system in order to control the coolant and the function of the pump, e.g. providing sensors for measuring temperature and pressure, etc. Providing the ejector pump 1,2 in the lower part of the tank 4 makes it possible to provide the ejector pump 1, 2 with coolant containing a less amount of gas than if this is placed such that cavitations appear.

The present invention makes it possible to decrease unnecessary power losses for ejector pumps when they are used for coolant liquid circulation and wet evaporation heat exchanger by gas bubble separation in the coolant liquid.

The invention also makes it possible to visually check that there is a sufficient quantity coolant at the ejector in order that the pump function works well, as well as checking the degree of filling of coolant in the cooling system. It also makes it possible to watch the liquid flow to the ejector in such a way that the system is started up and functions well with regard to access to coolant and the presence of gas at the ejector pump.

The invention shall be applied to cooling and heating systems with vaporising/condensing coolants as the working medium. The inspection glass device with ejector pump according to the invention can be applied to all types of cooling system with wet evaporators, such as air-conditioning, heat pump, process and apparatus cooling systems that use piston compressors, screw compressors, scroll compressors, centrifugal compressors, rotation compressors or some other type of compressor and all types of coolants for heat exchange by vaporization/condensation.

Of course the invention is not limited to the embodiments described above and illustrated in the attached drawings. Modifications are feasible, especially with respect to the different parts' characteristics, or by using comparable techniques, without on that account departing from the area of protection given in the patent claims.

REFERENCE SYMBOLS

1 Ejector nozzle.
2 Ejector diffuser.
3 Inspection glass.
4 Tank/accumulator for liquid/gas evaporation side.
5 Gas bubbles partly formed by heat from the expansion mixture. Removed from the pump into the tank due to gravity.
6 Liquid for recirculation via the ejector pump to vaporiser.
7 Connection apparatus between the inspection glass device and the tank.
8 Connection of the condensate expansion mixture/condensate to ejector nozzle, incoming pressure coolant for pump function.
9 Connection to vaporiser, from coolant exiting ejector pump.
10 Compressor.
11 Condenser.
12 Device with ejector and bubble separation.
13 Vaporiser.
14 Choke apparatus/expansion apparatus

The invention claimed is:

1. An ejector pump system for controlling a coolant in a cooling or heating system, said ejector pump system comprising:
- at least a compressor;
- a condenser in communication with said compressor;
- a coolant tank in communication with said condenser and said compressor;
- a vaporizer in communication with said coolant tank; and
- an ejector pump in communication with said coolant tank for coolant circulation through said vaporizer, said ejector pump comprising a connection to said ejector pump for intake of condensate from said condenser, an exit connection from said ejector pump for connection to said vaporizer, and a means for visually controlling said ejector pump.

2. The ejector pump system according to claim 1, wherein said means for visually controlling said ejector pump is an inspection glass.

3. The ejector pump system according to claim 2 further comprising a tank connection from said ejector pump to said coolant tank for communication of coolant between said coolant tank and said ejector pump.

4. The ejector pump system according to claim 3, wherein said ejector pump is arranged in, or in proximity to, a lower part of said coolant tank.

5. The ejector pump system according to claim 4, wherein said ejector pump further comprising a spray nozzle, an ejector diffuser, and an inlet passage between said spray nozzle and said diffuser.

6. The ejector pump system according to claim 5 further comprising an expansion apparatus arranged between said condenser and said spray nozzle.

7. The ejector pump system according to claim 6, wherein said connection for condensate from said condenser is connectable to said expansion apparatus of said spray nozzle of said ejector pump, said spray nozzle is arranged to aim a liquid gas jet at an inlet of said ejector diffuser so that the liquid gas jet aimed at said diffuser inlet can suck coolant from said coolant tank into said diffuser inlet via a free passageway between said spray nozzle and said diffuser inlet, wherein said free passage is in communication with a coolant present in said coolant tank through said tank connection.

8. An ejector pump device comprising:

an ejector pump in communication with a coolant tank of a heating or cooling system for coolant circulation through a vaporizer, said ejector pump having a means arranged to enable visual control of said ejector pump;

a connection arranged for intake of condensate from a condenser to said ejector pump; and an exit connection connectable to a vaporizer.

9. The ejector pump system according to claim 8, wherein said means for visually controlling said ejector pump is an inspection glass.

10. The ejector pump system according to claim 9 further comprising a tank connection from said ejector pump to said coolant tank for communication of coolant between said coolant tank and said ejector pump.

11. The ejector pump system according to claim 10, wherein said ejector pump further comprising a spray nozzle, an ejector diffuser, and an inlet passage between said spray nozzle and said diffuser.

12. The ejector pump system according to claim 11, wherein said connection for condensate from said condenser is connectable to said spray nozzle of said ejector pump, said spray nozzle is arranged to aim a liquid gas jet at an inlet of said ejector diffuser so that the liquid gas jet aimed at said diffuser inlet can suck coolant from said coolant tank into said diffuser inlet via a free passageway between said spray nozzle and said diffuser inlet, wherein said free passage is connectable and in communication with to said coolant present in said coolant tank.

13. The ejector pump system according to claim 12, wherein said ejector pump is arranged in, or in proximity to, a lower part of said coolant tank thereby allowing any gas bubbles that form around said ejector pump to be led effectively away from said ejector pump via said tank connection to said coolant tank by way of gravity.

14. An ejector pump system for controlling a coolant in a cooling or heating system, said ejector pump system comprising:

a flooded evaporator system having a compressor, a condenser in communication with said compressor, a coolant tank in communication with said condenser and said compressor, and a vaporizer in communication with said coolant tank; and an ejector pump in communication with said coolant tank for coolant circulation through said vaporizer, said ejector pump having a condenser connection for intake of condensate from said condenser, an exit connection for connection to said vaporizer, a spray nozzle in communication with said condenser connection, an ejector diffuser in communication with said exit connection, an inspection glass adjacent said spay nozzle and said ejector diffuser for visually controlling said ejector pump, and a tank connection from said ejector pump to said coolant tank for communication of coolant between said coolant tank and said ejector pump, said tank connection be adjacent said spray nozzle and said ejector diffuser opposite said inspection glass;

wherein said spray nozzle and said ejector diffuser being positioned inside said ejector pump so as to provide a gap therebetween forming a free passageway between said spray nozzle and an inlet of said ejector diffuser.

15. The ejector pump system according to claim 14, wherein said spray nozzle is arranged to aim a liquid gas jet at said inlet of said ejector diffuser so that the liquid gas jet aimed at said diffuser inlet can suck coolant from said coolant tank into said diffuser inlet via said free passageway, wherein said free passage is in communication with said coolant present in said coolant tank.

16. The ejector pump system according to claim 15, wherein said ejector pump is arranged in, or in proximity to, a lower part of said coolant tank thereby allowing any gas bubbles that form around said spray nozzle to be led effectively away from said spray nozzle via said tank connection to said coolant tank by way of gravity.

* * * * *